United States Patent [19]

Allen

[11] Patent Number: 4,798,494

[45] Date of Patent: Jan. 17, 1989

[54] FLOATING VIBRATIONAL SCREED

[75] Inventor: J. Dewayne Allen, Paragould, Ak.

[73] Assignee: Allen Engineering Corporation, Paragould, Ak.

[21] Appl. No.: 114,668

[22] Filed: Oct. 28, 1987

[51] Int. Cl.[4] ..... E01C 19/30

[52] U.S. Cl. ..... 404/114; 404/120

[58] Field of Search ..... 404/96, 97, 101, 114, 404/118, 120; 425/456, 458

[56] References Cited

U.S. PATENT DOCUMENTS

| | | | |
|---|---|---|---|
| 2,034,942 | 3/1936 | Dodds | 404/114 |
| 2,255,343 | 9/1941 | Baily | 404/114 |
| 2,314,985 | 3/1943 | Jackson | 404/114 |
| 2,473,961 | 6/1949 | Mandt et al. | 404/118 |
| 2,542,979 | 2/1951 | Barnes | 404/114 |
| 2,651,980 | 9/1953 | Wells et al. | 404/113 |
| 2,693,136 | 11/1954 | Barnes | 404/114 |
| 3,095,789 | 7/1963 | Melvin et al. | 404/114 |
| 3,262,378 | 7/1966 | Schrimper et al. | 404/120 |
| 3,415,173 | 12/1968 | Paul | 404/118 |
| 4,030,873 | 6/1977 | Morrison | 425/456 |
| 4,105,355 | 8/1978 | King et al. | 404/114 |
| 4,340,351 | 7/1982 | Owens | 425/456 |
| 4,349,328 | 9/1982 | Allen | 425/456 |
| 4,375,351 | 3/1983 | Allen | 425/456 |
| 4,386,901 | 6/1983 | Morrison | 425/456 |
| 4,544,346 | 10/1985 | Allen | 425/456 |
| 4,650,366 | 3/1987 | Morrison | 404/114 |
| 4,685,826 | 8/1987 | Allen | 404/114 |

OTHER PUBLICATIONS

Article, "Power Floating & Trowling", Carl O. Peterson, *Concrete Construction*, Sep. 1986, pp. 795–796.

Article, "A Primer of Finishing Tools", Carl O. Peterson, *Concrete Construction*, Sep. 1986, p. 786.

*Primary Examiner*—Jerome W. Massie, IV
*Assistant Examiner*—Matthew Smith
*Attorney, Agent, or Firm*—Stephen D. Carver

[57] ABSTRACT

A vibrating screed for striking off, float finishing and vibrating plastic concrete in a single pass, without being supported upon forms. A rigid, buoyant pan which floats and supports the screed comprises a generally planar surface portion in contact with the plastic concrete and a terminal portion coupled to an associated blade assembly. The blade assembly includes a central L-bracket having a lower horizontal portion substantially parallel with the pan, which terminates in a leading edge adapted to first contact and strike-off unfinished concrete. An associated face plate includes a central portion adapted to be rigidly fastened to the pan terminal portion with the L-bracket substantially sandwiched therebetween. The face plate comprises a downwardly angled guard member which defines a flotation volume between itself and the lower L-bracket, and an upper, diverging wing portion which prevents the accumulation of stricken-off concrete interiorly of the pan. A plurality of spaced apart pneumatic vibrators responsive to external HP air vigorously vibrate the screed pan. A pair of handles pivotally associated with the frame facilitate screed manipulation by a pair of workmen who pull the screed toward them while they are walking backwards. Pan flotation in cooperation with the blade configuration enables the entire apparatus to float upon wet concrete. When the handles are suitably rotated with respect to the frame (i.e. the center of gravity is aligned with the screed body), the entire screed may assume a floating stable and erect position.

21 Claims, 4 Drawing Sheets

FLOATING VIBRATIONAL SCREED

BACKGROUND OF THE INVENTION

The present invention relates generally to vibrating screeds and strike-offs for finishing plastic concrete. More particularly, the present invention is directed to a floating, vibrational screed adapted to finish plastic concrete without forms. The invention is believed best classified in U.S. Class 404, subclasses 114 and/or 118.

As will be recognized by those skilled in the concrete placing and finishing arts, after concrete is initially laid during construction, the upper surface must be appropriately finished to give it a smooth, homogenous and correctly textured form and appearance. A wide variety of vibrating equipment such as screeds for treating plastic concrete have previously been suggested. Known prior art systems include "bull" floaters, various forms of finishing boards, strike-offs, and the like. The "strike-off" phenomena involves contact of rough unfinished plastic concrete with a leading, cutting, or blade-like edge to initially form and grade fresh concrete.

It is conventional to employ vibration during concrete finishing, and many vibrating systems have previously been proposed. Vibration during screeding helps "settle" the concrete, and helps to densify and compact the concrete during finishing. Vibrational screeding also removes air voids and brings excess water and fine layers of cement aggregate to the surface for subsequent finishing and, in general, promotes the attainment of a uniform product. Often screeds are adapted to extend between and rest upon the forms between which the plastic concrete is actually confined. Forms constrain the concrete until it is set, and provide a working support for the typical screen or finishing machine.

A prior art self-propelled "triangular truss" screed of the form riding type is shown in my prior U.S. Pat. No. 4,577,993. A winch-driven, self-propelled screed is also seen in my prior U.S. Pat. No. 4,363,618 and the various references cited and discussed therein. My prior U.S. Pat. Nos. 4,349,328 and 4,316,715 are also germane to the general technology discussed herein. All of the above patents have been assigned to the same assignee as the present case.

Screeds capable of formless, self-supporting or floating operation are shown in U.S. Pat. Nos. 4,650,366 and 3,386,901. The latter reference discloses a relatively heavy triangular truss screed adapted to be employed by a pair of workmen without the use of forms. U.S. Pat. No. 4,650,366 discloses a light weight, portable vibrating screed including a central, extruded beam element. A floating screed manufactured by Les Placements Paro of Canada, although it is not necessarily prior art and it is apparently unpatented, is believed relevant. It includes a floating pan which is physically offset from, and adjustably coupled to, a parallel and spaced-apart strike-off knife assembly.

U.S. Pat. No. 3,431,336 discloses a vibrating finishing screed adapted for use upon plastic concrete which apparently is capable of floating. U.S. Pat. No. 2,314,985 discloses a vibratory hand screed including a central, vibrated pan which is apparently adapted for use upon plastic concrete without support upon confining forms.

Other prior art includes "bull floaters" which have long been used in the concrete finishing arts. Such devices essentially comprise a flat wooden board attached to a handle, much like a broom handle, which are adapted to be manipulated by a single worker. Another prior art floating screed of general relevance is disclosed in a video tape produced by the American Concrete Institute and The Portland Cement Association, entitled "Finishing Concrete Flatwork," which bears a Copyright date of 1984. Other prior art screeds, generally of the "form-riding" type, include those screeds disclosed in U.S. Pat. Nos. 4,340,351; 4,105,355; 2,651,980; 2,542,979; 3,095,789; 2,693,136; and 4,030,873.

However, none of the prior art devices known to me provide a satisfactorily efficient system for manually finishing plastic concrete with portable, formless, floating screeds which can be conveniently and concurrently used for vibrating, striking-off, and float finishing. I have discovered an important function in the combined strike-off and flotation screed finishing function, which resides in the relationship between the buoyancy of the pan, its resultant surface tension, and the overall center of gravity obtained by the apparatus, and I have endeavored to perfect a floating screed wherein the aforementioned factors are harmoniously balanced.

SUMMARY OF THE INVENTION

The present invention comprises a portable, self-floating vibrating screed adapted to be used by one or more workmen for striking off, float finishing, and vibrating plastic concrete without forms in a single pass. Unlike earlier heavier self-propelled type screeds, the present invention may be employed upon plastic concrete confined with or without forms, and its flotational characteristics make it ideal for a wide variety of applications.

The screed forcibly distributes vibration upon the surface of unfinished plastic concrete. An elongated, substantially rigid pan member generates buoyancy to float and support the entire screed apparatus. The pan, which smoothly glides and floats upon the surface of plastic concrete, comprises a generally planar surface portion in contact with finished concrete and a terminal portion adapted to be coupled to an associated blade assembly.

The blade assembly includes a central L-bracket having a lower horizontal portion substantially parallel with the pan. This horizontal portion terminates in a leading edge adapted to strike off concrete, and the L-bracket is preferably substantially covered by a generally wing-shaped face plate. The face plate includes a central portion adapted to be rigidly compressed against the adjacent L-bracket vertical portion and the adjacent pan terminal portion, and a downwardly angled guard member which defines a flotation volume between itself and the lower L-bracket. An upper wing portion extends forwardly at the top of the face plate, to prevent the accumulation or deposition of concrete upon either associated vibrators or within the pan flotation surface.

The pan assembly and the blade assembly are thus rigidly coupled together, forming an elongated, central frame which is coextensive between opposite ends of the screed. To this central frame member are coupled a plurality of spaced-apart pneumatic vibrators which are forcibly vibrated by a source of external HP (high pressure) air. A pair of handles pivotally associated with the frame facilitate screed manipulation by a pair of workmen. Pan flotation in cooperation with the blade configuration enables the entire apparatus to float upon wet concrete. When the handles are suitably rotated with respect to the frame (i.e., the center of gravity is aligned with the screed body), the entire screed may assume a floating, stable and erect position.

Thus a primary object of the present invention is to provide a conveniently operable portable and floating vibrating screed for finishing plastic concrete.

A more particular object of the present invention is to provide a portable, self-floating vibrating screed for striking off, float finishing, and vibrating plastic concrete without forms in a single pass.

A related object is to provide a portable, self-floating wet screeding apparatus for generating a uniform concrete finish without forms.

Another object of the present invention is to provide a floating vibrating screed of the character described adapted to be easily maneuvered by workmen without the use of external drive systems such as winches and the like.

Another fundamental object of the present invention is to provide a floating vibrating screed of the character described which may be varied in length as desired by the workmen upon a job site.

Yet another object of the present invention is to provide a screed that may be used in finishing plastic concrete with or without forms.

A still further object of the present invention is to provide a floating screed of the character described which provides and distributes uniform vibration.

A similar object is to provide a floating, portable screed adapted to be easily balanced and self-supporting upon plastic concrete.

A feature of the present invention is that the entire screed floats upon wet concrete with or without horizontal movement imparted by workmen.

A similar object of the present invention is to provide or establish a grade on a wet screeded runway, and it is a feature of the present invention that conventional laser leveling hardware may be easily installed upon the device.

Yet another object of the present invention is to provide enough flotation in a screed of the character described so as to make it ideal for use with higher slump concrete.

A similar basic object of the present invention is to provide an easily manually operable floating vibrating screed of the character described adapted to strike-off and float-finish concrete without forms.

Another object is to provide a vibrating screed which facilitates sideways slewing during float finishing of concrete.

A similar object is to provide a portable, floating vibrating screed of the character described which may be easily maneuvered to avoid such objects as columns, pipes, wiring, conduits and the like which might otherwise interrupt or impede a conventional form-riding screed.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
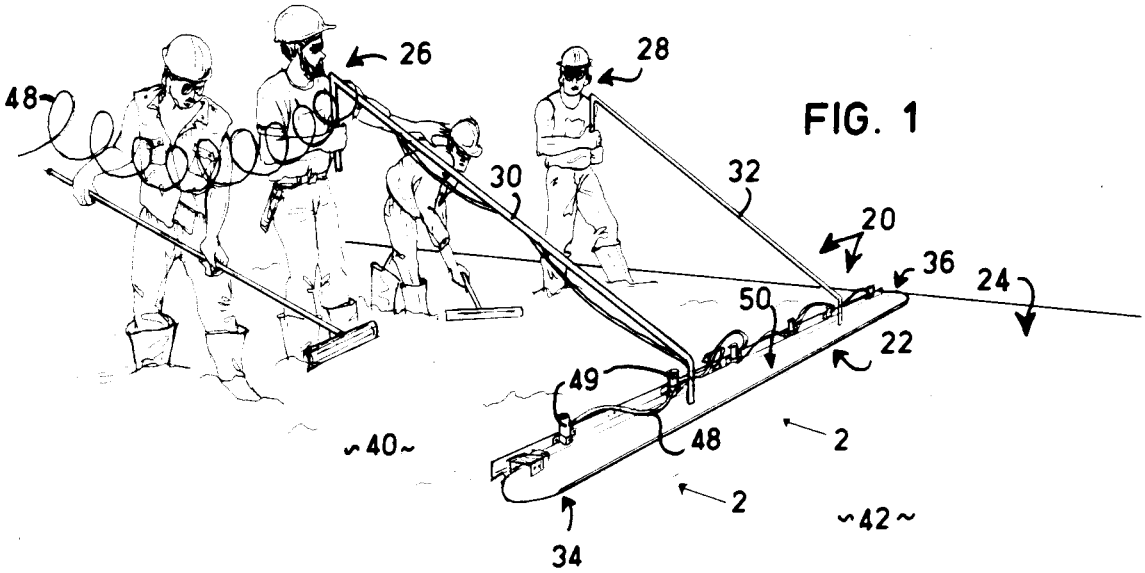
FIG. 1 is a fragmentary, pictorial view illustrating the best mode of my new Floating Vibrational Screed in use upon a concrete runway.
Figure 2:
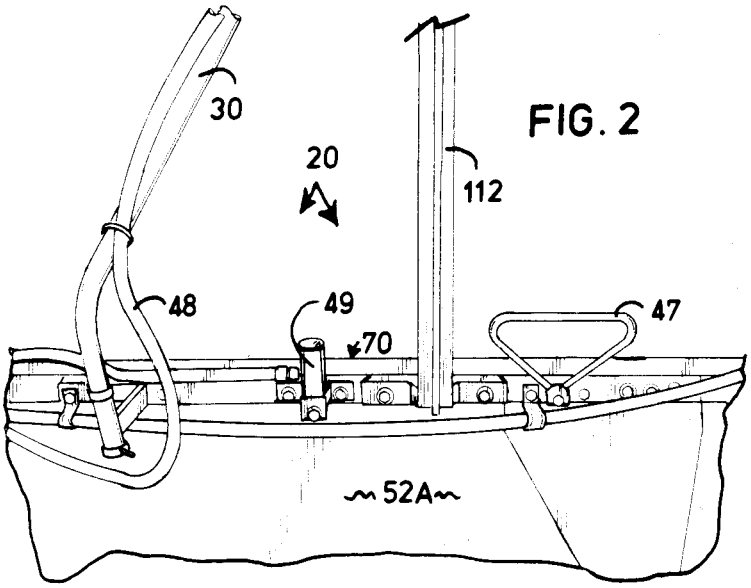
FIG. 2 is an enlarged scale, fragmentary, rear perspective view thereof.

With initial reference directed now to FIG. 1 of the appended drawings, a floating, vibrating screed constructed in accordance with the best mode of the present invention has been generally designated by the reference numeral 20. Screed 20 comprises an elongated, generally, rectangular body, generally designated by the reference numeral 22, which is adapted to be substantially transversely oriented upon a concrete runway generally designated by the reference numeral 24. As will be discussed hereinafter, it may be adjusted in length to suit the desired application, and it may be efficiently employed without the necessity of riding upon forms.

The screed body 22 terminates in a pair of spaced apart ends designated generally by the reference numerals 34 and 36. These ends need not be disposed upon or supported by forms for proper screed operation. As illustrated in FIG. 1, the surface of the concrete includes a rough unfinished surface 40 adapted to be substantially finished by passage of the screed 22 as it is manually pulled by workmen 26, 28. The screed is adapted to be manually operated by a pair of workmen 26, 28 who pull the screed toward them while walking backwards along the runway. Manipulation is facilitated via handles 30 and 32, which are pivotally coupled to the screed body, and which may be conveniently grasped. The concrete region broadly designated by the reference numeral 42 has been substantially finished, in that it has been treated by passage of the vibrating screed, and surface irregularities have been substantially struck off as will be hereinafter described. Vibration is preferably imparted pneumatically through a conventional air line 48 which actuates a plurality of conventional, spaced apart pneumatic vibrators 49 disposed at regular intervals along screed body 22. As best viewed in FIG. 1, the air line is preferably routed through the hollow interior of a handle 30.

With additional reference now directed to FIGS. 2–12, screed body 22 includes an elongated, preferably aluminum flotation pan, generally designated by the reference numeral 50, which extends between and terminates in opposite ends 36 and 34. Pan 50 is configured to provide buoyancy so as to float the entire screed 20 upon the surface of the plastic concrete to be finished. The generally planar pan includes a central, flat flotation surface portion 52 (FIG. 6) having a lower surface 52B which rides upon and directly contacts the plastic concrete. An opposite, upper interior surface portion 52A of pan 50 is located between an integral terminal coupling portion, broadly designated by the reference numeral 58 (FIG. 6), and an integral, outwardly angled rear edge 62 which projects upwardly away from contact with the concrete. The confined interior volume 64 of the pan provides sufficient buoyancy so as to float the screed 20, and the pan underside 52B which is in contact with the plastic concrete provides suction by virtue of its surface-to-surface contact with the plastic concrete. The terminal coupling portion 58 of the pan comprises a vertical portion 59A which is integral with an angled bridge portion 59B. It will be apparent that a buoyancy region 57 is defined between terminal portion 59B, the surface of the plastic concrete (such as surface 42), and the blade apparatus 70 to be hereinafter described.

With reference particularly directed to FIGS. 5, 6, 9, and 10, screed body 22 also comprises an elongated blade assembly generally designated by the reference numeral 70, which operationally first contacts and thus strikes off rough concrete. Blade assembly 70 preferably comprises a rigid, generally L-shaped bracket 72 which is formed from an elongated, aluminum extrusion. Bracket 72 includes a generally vertical portion 74 which is integral with a lower generally horizontal portion 76 which terminates in a leading edge 78. Horizontal bracket portion 76 is substantially parallel with the spaced apart planar bottom 52 of the pan. The blade assembly 70 also comprises a generally wing-shaped face plate 80 also formed from a rigid extrusion, which extends transversely across the screed body.

Figure 6:
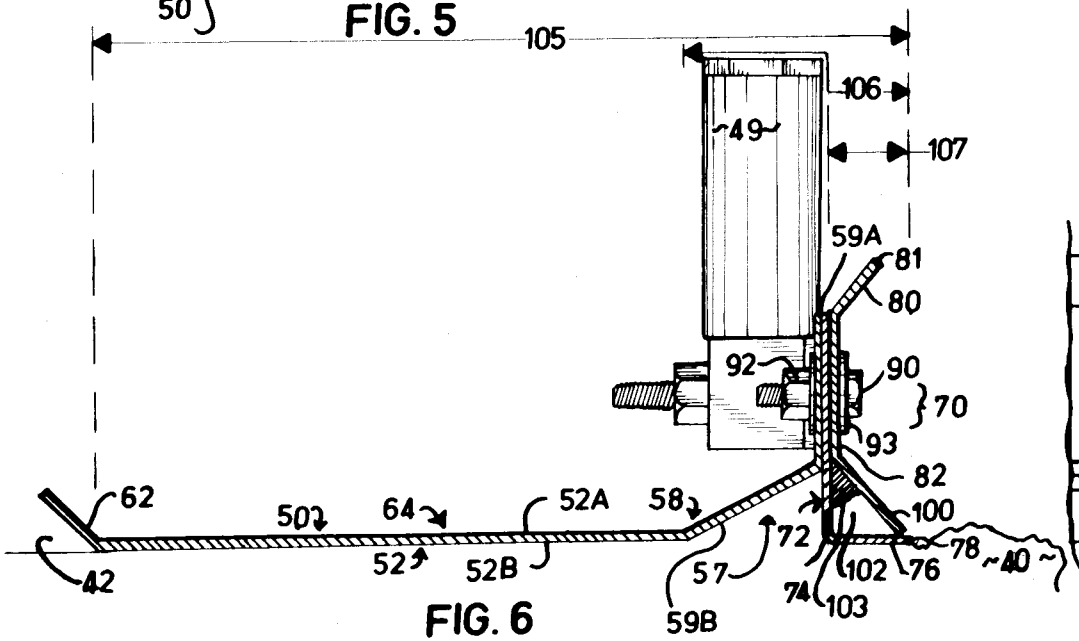
FIG. 6 is a fragmentary sectional view taken generally along line 6—6 of FIG. 5.
Figure 9:
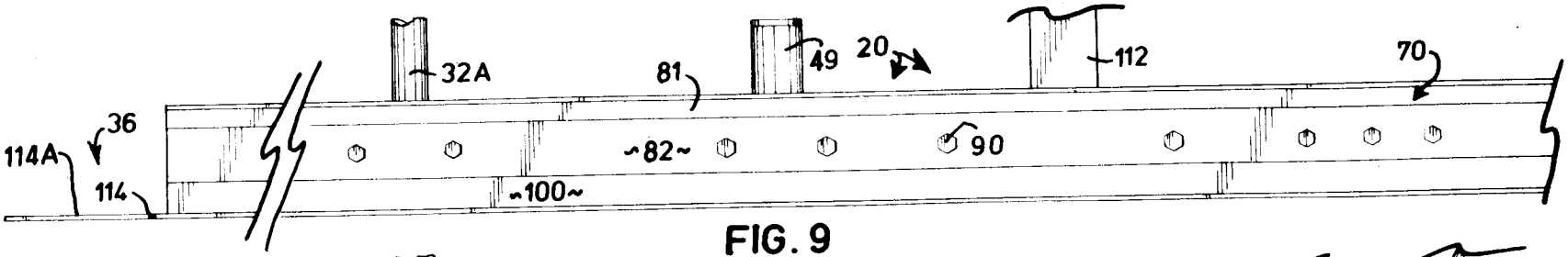
FIG. 9 is a fragmentary front elevational view of the preferred blade apparatus.
Figure 10:
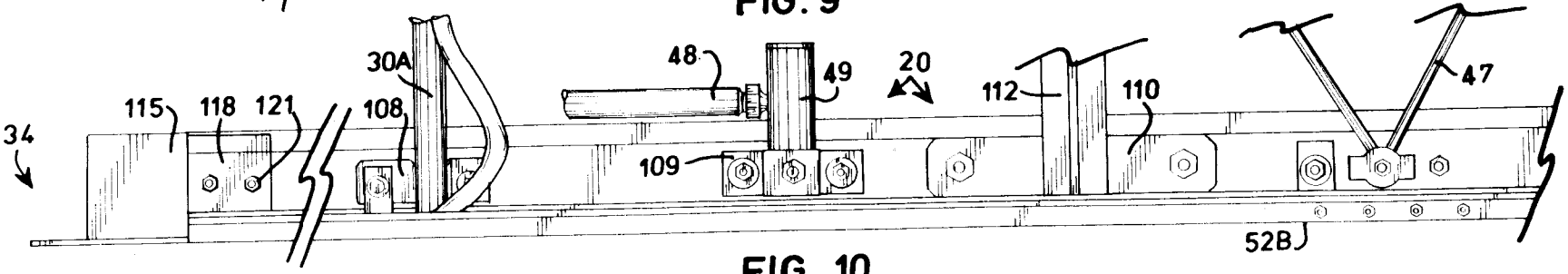
FIG. 10 is a fragmentary rear elevational view illustrating the pan and the blade apparatus.

Faceplate 80 includes an upwardly, outwardly diverging guard portion 81 and a central portion 82 which is adapted to be rigidly fastened to the pan terminal portion 58 with angle bracket segment 74 sandwiched therebetween. It will be noted that a plurality of conventional bolts 90 fastened by conventional nuts 92 which are regularly spaced apart along the screed body compressively secure the blade and pan assemblies together between conventional washers 93 (FIG. 6). The lower integral downwardly angled portion 100 of the face plate 80 projects angularly towards leading edge 78 of L-bracket 72, and defines a flotation volume 102 therebetween. Volume 102, which is generally triangular in cross section, longitudinally extends across the screed body. Volume 102 is preferably filled with lightweight styrofoam 103 and is appropriately sealed at its ends with caulking. Volume 102 thus tends to aid in "floating" the entire assembly.

A balancing boundary region is essentially defined across the entire screed pan assembly coplanar with the vertical portion 74 of the L-bracket. As viewed in FIG. 6, the pan extends generally to the left of this boundary, and the blade assembly extends generally to the right. It is important to balance the weight and surface tensions of the pan against the "striking off" forces developed by the blade assembly, particularly leading edge 78, and it is important to dynamically balance the tilting forces which may be applied to the screed by the workmen when manipulating the handles. The boundary region is essentially coincident with the sandwich combination of pan terminal portion 59A, vertical portion 74 of blade L-bracket 72, and the cooperating central face plate portion 82, all of which are bolted together. In FIG. 6 a width 105 extends between the leading blade edge 78 and the pan junction of bevel 62. A width 106 is similarly defined between edge 78 and the bevel junction formed by the intersection of pan segment 59B. A width 107 extends between L-bracket edge 78 and vertical portion 74. In the best mode known to me at this time, and for purposes of illustration only, dimensions 105, 106 and 107 are respectively eleven inches, three and three sixteenths inches, and one and three sixteenths inches. In the best mode the ratio between dimensions 105 and 107 is approximately 9.24, and the ratio between dimensions 105 and 106 is approximately 3.45.

The operating handles 30 and 32 each include elongated horizontal portions extending from downwardly turned vertical portions 30A or 32A (FIGS. 9 and 10) which are pivotally coupled to suitable brackets 108 suitably bolted to the screed body. Each of the preferably pneumatic vibrators 49 are also coupled to the screed body via suitable brackets 109 (FIG. 9) which are permanently bolted into the screed body. At least one lifting handle 47 is preferably fastened to the screed body to facilitate user installation and manipulation.

A pair of vertically upright, spaced-apart laser support masts 112 (FIGS. 9–11) are attached to the screed frame through suitable flanges 110. These masts extend vertically upwardly for reception of suitable conventional laser leveling equipment. The masts terminate in suitable swivels for rotatably mounting appropriate laser receivers, such as conventional Spectra Physics brand equipment, which function in cooperation with a remotely disposed laser reference transmitter system. When used during screeding, a "leveling" signal may be derived so as to control the screeding operation and attain a desired grade.

Figure 3:
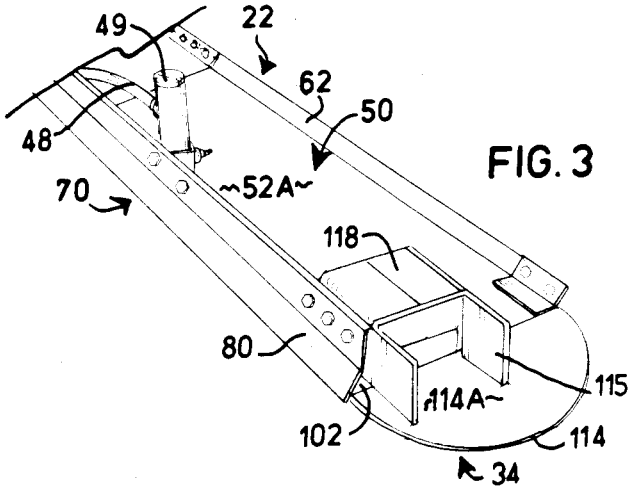
FIG. 3 is an enlarged scale, fragmentary, perspective view of one end thereof.
Figure 4:
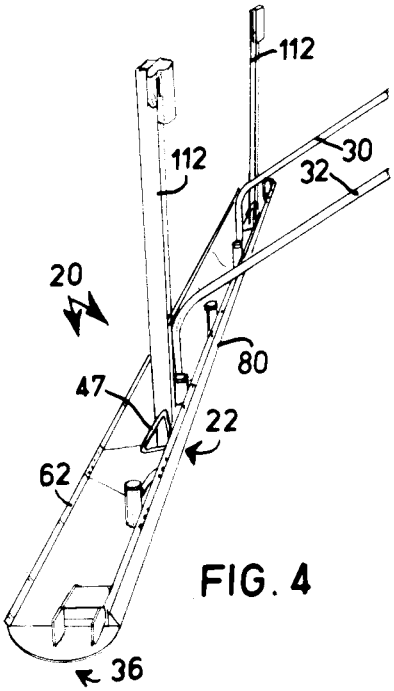
FIG. 4 is a fragmentary perspective view of the opposite end thereof.
Figure 7:
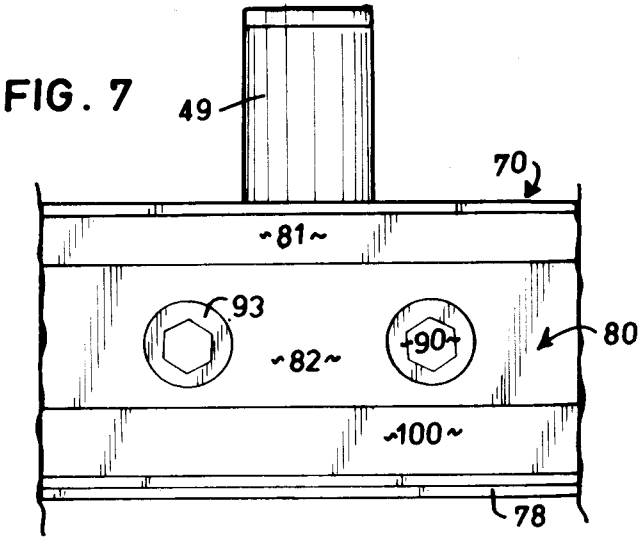
FIG. 7 is a fragmentary front elevational view thereof.
Figure 8:
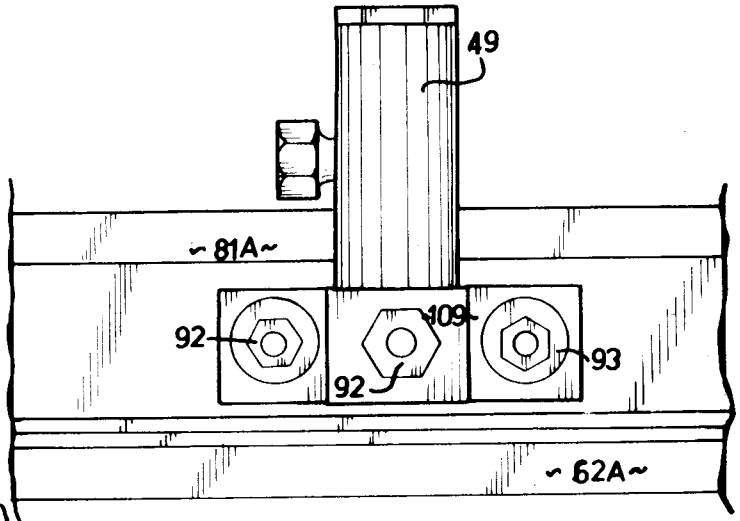
FIG. 8 is a fragmentary rear elevational view thereof.
Figure 5:
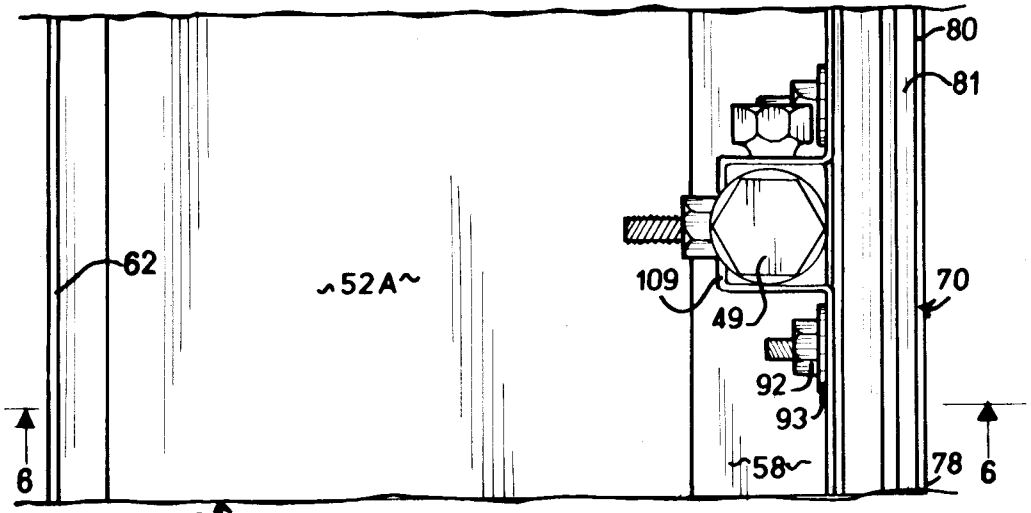
FIG. 5 is an enlarged scale, fragmentary top plan view thereof.
Figure 11:
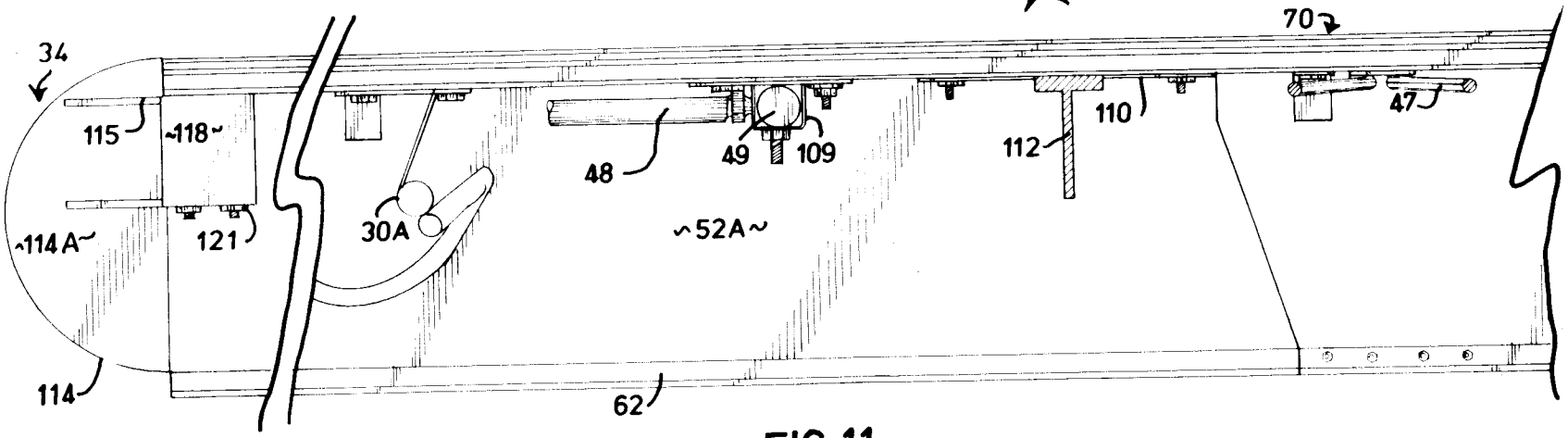
FIG. 11 is a fragmentary top plan view illustrating the pan.

With reference directed now to FIGS. 3 and 11, the terminal ends 34, 36 are provided with a preferably semicircular terminus 114 secured by a pair of brackets 115 extending from a weldment 118 rigidly secured to the horizontal frame previously discussed through conventional nut and bolt combinations 121. The terminus surface portion 114 is generally parallel with the elongated surfaces of the pan assembly 52 previously discussed.

Figure 12:
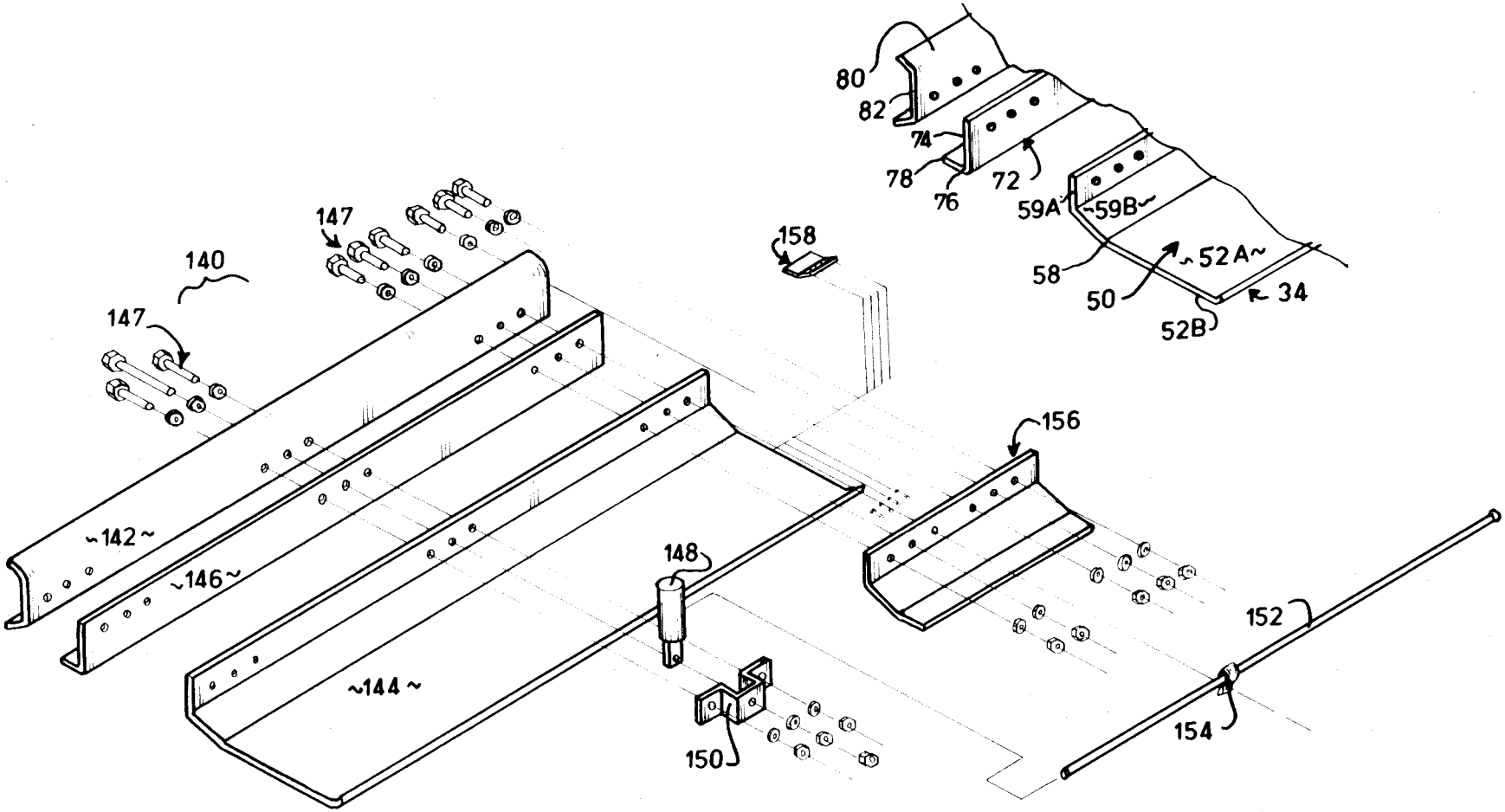
FIG. 12 is a fragmentary, exploded, isometric view illustrating an optional end extension system adapted to be employed to lengthen the screed of the present invention.

With specific reference now directed to FIG. 12 of the drawings, the typical extension system is generally designated by the reference numeral 140. By use of system 140, the effective length of the body 22 can be enlarged to fit a particular application. As will be appreciated by those skilled in the art, an extension system 140 will be used on each side of the apparatus 20, and it is adapted to be removably coupled to each end of the screed, such as end 34 shown in fragmentary form. It includes individual elements which cooperate to lengthen the blade and pan previously discussed. In general, a face plate assembly 140 is adapted to be secured relative to a pan extension 144 with an L-bracket 146 rigidly secured therebetween. Thus an extension of the blade assembly will be formed of members 142 and 146, and the pan similarly will be extended by member 144. A plurality of nut-and-bolt combinations generally designated by the reference numeral 147 may be employed as indicated to secure the apparatus together.

Additionally, a suitable vibrator 148 may be secured by a bracket 154. A splicing plate generally designated by the reference numeral 156 is employed at the coupling end of the apparatus and is firmly bolted together so as to splice the extension 140 to the screed end. Front splice plate 156 thus cooperates with rear splice plate 158 which is conformed to the surface of the pan so as to splice and bridge the rear beveled edge of adjacent pan segments together.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A floating screed for finishing plastic concrete with or without forms, said screed comprising:

an elongated, buoyant pan adapted to float upon plastic concrete, said pan comprising a generally planar flotation surface portion adapted to contact concrete, an interior, and an integral terminal portion;

an elongated blade assembly having a leading edge adapted to initially contact rough concrete during operation of said screed, said blade assembly rigidly coupled to said pan terminal portion and defining a buoyancy flotation volume adjacent said leading edge, said blade assembly comprising:

a rigid L-bracket having a substantially horizontal portion oriented substantially parallel with said pan and terminating in said leading edge, and an integral substantially vertical portion adapted to be fastened to said pan terminal portion; and, a face plate comprising a central substantially vertically oriented portion adapted to be rigidly secured to said L-bracket and a lower angled portion extending forwardly downwardly into substantial contact with said leading edge whereby to define said flotation volume between said L-bracket and said face plate;

a pair of opposite ends between which said pan and said blade assembly longitudinally extend;

handle means operatively associated with said screed for enabling manual control and manipulation thereof, said handle means coupled to said screed between said opposite ends thereof; and, vibrator means for vibrating said screed.

2. The screed as defined in claim 1 wherein said face plate comprises an integral, upwardly outwardly angled guard portion for preventing the transmission of loose concrete to the interior of said pan.

3. The screed as defined in claim 1 wherein said pan terminal portion comprises an integral, substantially vertical portion adapted to be rigidly coupled to said L-bracket and said face plate, and an integral angled portion extending between said last mentioned substantially vertical portion and said generally planar pan surface portion.

4. The screed as defined in claim 3 wherein a buoyant region is defined between the angled portion of said pan terminal portion, said L-bracket, and the surface of concrete being finished.

5. The screed as defined in claim 3 wherein said pan terminates in a beveled edge adapted to smoothly reduce surface tension between wet concrete and the moving planar surface.

6. The screed as defined in claim 3 wherein said face plate comprises an integral, upwardly outwardly angled guard portion for preventing the transmission of loose concrete to the interior of said pan.

7. A floating, portable screed for vibrating, striking off, and float finishing plastic concrete with or without forms, said screed comprising:

an elongated, buoyant pan adapted to float upon plastic concrete, said pan comprising a generally planar, flotation surface portion adapted to contact said concrete, an interior, and an integral, angled terminal portion;

an elongated blade assembly having a leading edge adapted to initially contact rough concrete during operation of said screed, said blade assembly comprising:

a rigid L-bracket having a lower horizontal portion oriented substantially parallel with said pan and terminating in said leading edge, and an integral substantially vertical portion adapted to be fastened to said pan terminal portion; and, a face plate comprising a central substantially vertically oriented portion adapted to be rigidly secured with said L-bracket to said pan terminal portion and a lower angled portion extending forwardly downwardly into substantial contact with said leading edge whereby to define a flotation volume; and, a pair of opposite ends between which said pan and said blade assembly longitudinally extend;

handle means operatively associated with said screed for enabling manual control and manipulation thereof, said handle means pivotally coupled to said screed between said opposite ends thereof; and, vibrator means for vibrating said screed.

8. The screed as defined in claim 7 wherein said face plate comprises an integral, upwardly outwardly angled guard portion for preventing the transmission of loose concrete to the interior of said pan.

9. The screed as defined in claim 7 wherein said pan terminal portion comprises an integral, substantially vertical portion adapted to be rigidly coupled to said L-bracket and said face plate, and an integral angled portion extending between said last mentioned substantially vertical portion and said generally planar pan surface portion.

10. The screed as defined in claim 9 wherein a buoyant region is defined between the angled portion of said pan terminal portion, said L-bracket, and the surface of concrete being finished.

11. The screed as defined in claim 10 wherein said pan terminates in a beveled edge adapted to smoothly reduce surface tension between wet concrete and the moving planar surface.

12. A floating, portable manually operable screed for striking off, vibrating, and float finishing plastic concrete with or without forms in a single pass, said screed comprising:

an elongated, buoyant pan adapted to float upon plastic concrete, said pan comprising a generally planar, flotation surface portion adapted to contact said concrete, an interior, and an integral, angled terminal portion;

an elongated blade assembly having a leading edge adapted to initially contact rough concrete during operation of said screed, said blade assembly comprising:

a rigid L-bracket having a lower horizontal portion oriented substantially parallel with said pan and terminating in said leading edge, and an integral substantially vertical portion adapted to be fastened to said pan terminal portion; and, a face plate comprising a central substantially vertically oriented portion adapted to be rigidly secured with said L-bracket to said pan terminal portion, a lower angled portion extending forwardly downwardly into substantial contact with said leading edge whereby to define a flotation volume between said L-bracket and said face plate, and an integral, upwardly outwardly angled guard portion for preventing the transmission of loose concrete to the interior of said pan;

said pan terminating in a pair of opposite, rounded ends between which said pan and said blade assembly longitudinally extend, said ends being substantially coplanar with said pan;

said pan terminal portion comprising an integral, substantially vertical portion adapted to be rigidly coupled to said L-bracket and said face plate with said face plate vertical portion sandwiched in between, and an integral angled portion extending between said last mentioned substantially vertical portion and said generally planar pan surface portion;

handle means pivotally coupled to said screed for enabling workers to pull the screed toward them while they are walking backwards, said handle means pivotally coupled to said pan between said opposite ends thereof; and, a plurality of spaced apart pneumatic vibrators mounted upon said screed for providing vigorous vibration in response to connection to an external source of pressure.

13. The screed as defined in claim 12 wherein a buoyant region is defined between the angled portion of said pan terminal portion, said L-bracket, and the surface of concrete being finished.

14. The screed as defined in claim 13 wherein a first dimension extends between the leading blade edge and the pan junction with a rear pan bevel, a second dimension is defined between said L-bracket leading edge and the L-bracket vertical portion, and the ratio between said first and second dimensions is between six and eleven.

15. The screed as defined in claim 14 wherein said ratio is approximately 9.

16. The screed as defined in claim 14 where a third dimension defined between said leading edge and a pan junction with a front pan bevel, and the ratio between said first dimension and said third dimension is between 2 and 5.

17. The screed as defined in claim 16 wherein said last mentioned ratio is approximately 3.

18. A floating screed for finishing plastic concrete without requiring forms, said screed comprising:

elongated, buoyant pan means for floating upon plastic concrete to be finished, said pan means comprising a generally planar flotation surface portion adapted to contact said concrete, a terminal edge, and an interior;

elongated blade means for cutting, striking off and leveling rough concrete, said blade means rigidly associated with said pan means terminal edge and comprising:

leading edge means for initially contacting uneven concrete during operation of said screed; and, face plate means extending forwardly downwardly toward said leading edge means for redirecting struck-off concrete away from said pan means, said face plate means comprising an upwardly outwardly extending guard portion for preventing the transmission of loose concrete to the interior of said pan means;

a pair of opposite ends between which said pan means and said blade means longitudinally extend;

handle means operatively associated with said screed for enabling manual control and manipulation thereof, said handle means coupled to said screed between said opposite ends thereof; and, vibrator means for vibrating said screed.

19. The screed as defined in claim 18 wherein said pan means terminates in a beveled edge adapted to smoothly reduce surface tension between wet concrete and the moving planar surface.

20. The screed as defined in claim 18 wherein said pan means terminal portion comprises an integral, substantially vertical portion adapted to be rigidly coupled to said face plate means, and an integral angled portion extending between said last mentioned substantially vertical portion and said generally planar pan surface portion.

21. The screed as defined in claim 18 wherein a buoyant region is defined between the angled portion of said pan terminal portion, said face plate means, and the surface concrete being finished.

* * * * *